United States Patent [19]

Crosby

[11] Patent Number: 4,821,380

[45] Date of Patent: Apr. 18, 1989

[54] QUICK CINCH

[76] Inventor: Eddie G. Crosby, 1609 E. 46th Pl., Tulsa, Okla. 74105

[21] Appl. No.: 102,004

[22] Filed: Sep. 28, 1987

[51] Int. Cl.[4] ..... B68C 1/00

[52] U.S. Cl. ..... 54/23; 24/71 R; 24/71 T; 24/191

[58] Field of Search ..... 24/71 R, 71 ST, 71 A, 24/71 SB, 71 TD, 71 CT, 71 T, 71 TT, 69 ST, 69 CT, 69 AT, 69 R, 69 CF, 69 TM, 69 TS, 69 S, 69 FP, 69 SB, 69 EF, 68 E, 68 SK, 68 CT, 68 D, 68 PP, 68 F, 68 SB, 68 AS, 68 FP, 164, 170, 191, 193; 54/27, 23, 28, 46

[56] References Cited

U.S. PATENT DOCUMENTS

| | | | |
|---|---|---|---|
| 398,714 | 2/1889 | Farr | 24/71 TD |
| 952,773 | 3/1910 | Wilty | 24/68 CT |
| 1,032,755 | 7/1912 | Humphrey | 24/191 |
| 1,280,408 | 10/1918 | Cox | 24/68 CT |
| 1,962,285 | 6/1934 | Robinson | 24/191 X |
| 2,541,706 | 2/1951 | Levine | 24/68 E |
| 2,638,647 | 5/1953 | Nielsen | 24/68 CT |
| 3,271,007 | 9/1966 | Ratcliff | 24/71 TD X |
| 3,641,630 | 2/1972 | Farley | 24/193 X |
| 4,122,560 | 10/1978 | Baker | 24/71 ST X |

FOREIGN PATENT DOCUMENTS

| | | | |
|---|---|---|---|
| 96943 | 4/1898 | Fed. Rep. of Germany | 24/170 |
| 11854 | 3/1924 | Netherlands | 24/69 CT |

*Primary Examiner*—Kenneth J. Dorner
*Assistant Examiner*—Laurie K. Cranmer
*Attorney, Agent, or Firm*—Head & Johnson

[57] ABSTRACT

A "quick cinch" is provided to replace the latigo normally used on a saddle for tightening the cinch around the stomach of a horse. There is a first or upper U-shaped member which has two parallel arms and a top or cross member to complete the U configuration. The top cross member extends beyond the parallel arms for using as a stop when connected to the D-ring that is secured to the saddle. These stops hook with the D-ring. A second U-shaped member having two arms is provided. The ends of the arms of the first and second U-shaped member are pivotally connected. A strap bar is provided between the two arms of the second U-shaped member intermediate the ends thereof. A piece of leather extends over the strap bar and is buckled to the ring on the cinch and the top of the other U-shaped member is hooked to the ring which is secured to the saddle. Then movement of the second U-shaped member with respect to the first will tighten the cinch. A safety catch is provided so that the lever mechanism cannot be accidentally opened.

7 Claims, 4 Drawing Sheets

QUICK CINCH

BACKGROUND OF THE INVENTION

This invention relates to a device for tightening the girth or cinch or saddles for use with horses.

People have been riding horses for centuries. A saddle for the rider is placed upon the back of a horse and is cinched to the horse. This is accomplished by the use of a cinch or girth which is normally a flat piece of several strands of soft rope which may typically be four or five inches wide and may be about fifteen to sixteen inches long. Each end of the girth is provided with a ring having a tongue. One end of the girth is connected to one side of the saddle with a leather strap with holes and the tongue of that ring is inserted through a selected hole. The other end of the girth is connected to the saddle by what is called a latigo which is a long strap on the saddle tree to tighten and fasten the cinch to the saddle. After the saddle is placed on the horse the latigo is used to fasten the cinch and it is pulled up by hand until the proper tightness of the cinch is obtained and the latigo is secured in that position by the tongue of the second ring of the cinch.

SUMMARY OF THE INVENTION

This quick cinch device is a device for replacing the latigo for connecting a cinch to a ring connected to a saddle for securing the saddle to a horse. It includes two U-shaped members. The upper or saddle connecting U member has two essentially parallel connecting arms. A top bar connects the ends of the connecting arms to complete the U-shaped configuration. The top bar extends beyond each arm so that it can form a hook for attaching to the saddle ring. A lower or tightening lever or strap connecting U-shaped member has two parallel lever arms which at the open end of the U-shaped member is pivotally connected to the ends of the connecting arms of the saddle connecting U-shaped member. A strap bar is provided between the tightening lever arms and is intermediate the ends thereof.

In operation, the top bar of the saddle connecting U-shaped member is inserted through and connected or hooked to the saddle ring. At this point the two U-shaped members are in their expanded position. A strap is connected over the strap bar at one end and at another selected position to the ring on the cinch. Now all that is necessary to do to obtain the tightening of the cinch is to rotate the tightening U-shaped member about the pivot points until the tightening U-shaped member is adjacent the saddle connecting U-shaped member. A safety catch is provided between the two U-shaped members so that they cannot come undone. The cinch is now tightened and the saddle will be held in place.

DETAILED DESCRIPTION OF THE INVENTION

Figure 1:
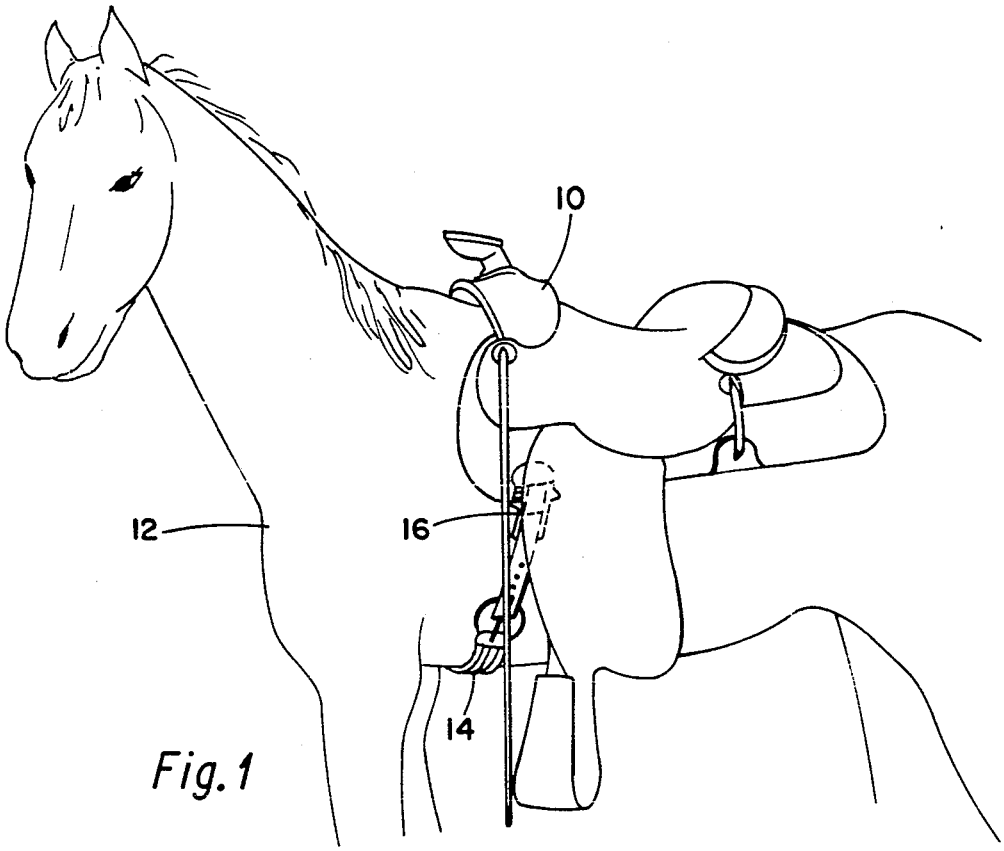
FIG. 1 shows a saddle held onto a horse by use of the quick cinch of my invention.

Attention is first directed to FIG. 1 which shows a saddle 10 mounted on a horse 12. The saddle 10 is held in position by a girth 14 which is tightened beneath the horse with my quick cinch 16.

Figure 2:
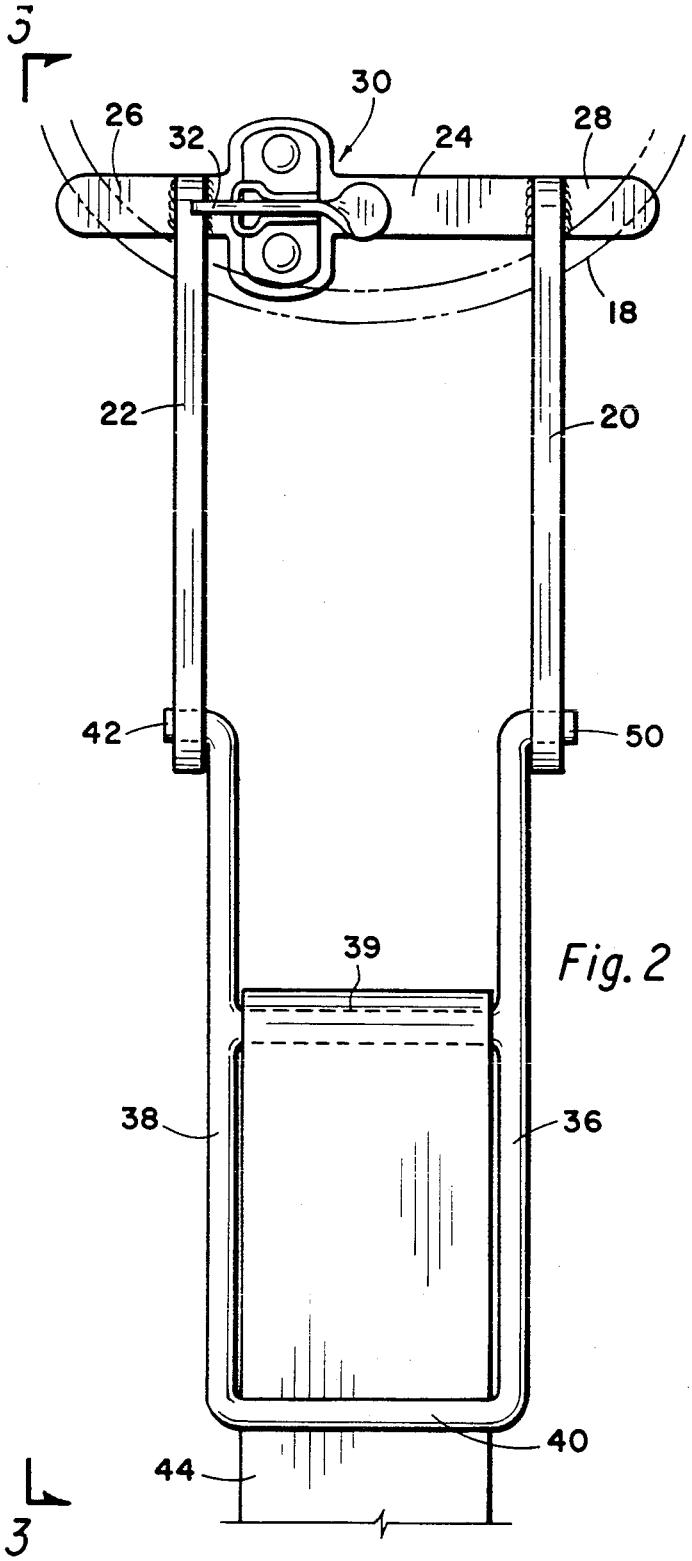
FIG. 2 shows one embodiment of the quick cinch of my invention in a relaxed position.
Figure 8:
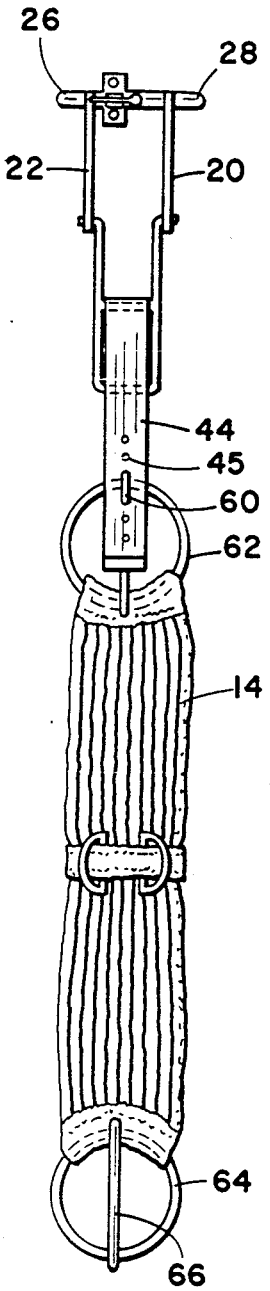
FIG. 8 shows a girth with the embodiment of FIG. 2 attached thereto.

Attention is next directed to FIG. 2 which shows the quick cinch in a relaxed position. The quick cinch has an upper or saddle connecting U-shaped member and a lower U-shaped member connected together by pivots so that a lever type action is obtained. The upper U-shaped member includes connecting arms 20 and 22 with a cross member 24 at the top. The lower U-shaped member includes two parallel tightening lever rods 36 and 38 with pivot ears 50 and 42 respectively which extends through holes in the lower ends of connecting arms 20 and 22. The lower end of the tightening levers are connected by a cross member 40. The strap bar 39 is connected between tightening lever rods 36 and 38 intermediate the ends therof. A strap 44, as shown more clearly in FIG. 3, loops up over strap bar 39. As shown in FIG. 8 strap 44 is provided with a plurality of holes 45 through which tongue 60 of ring 62 of girth 14 may be connected. Girth 14 is connected with ring 64 and tongue 66 to the flank of the saddle on the other side of a conventional manner.

Figure 3:
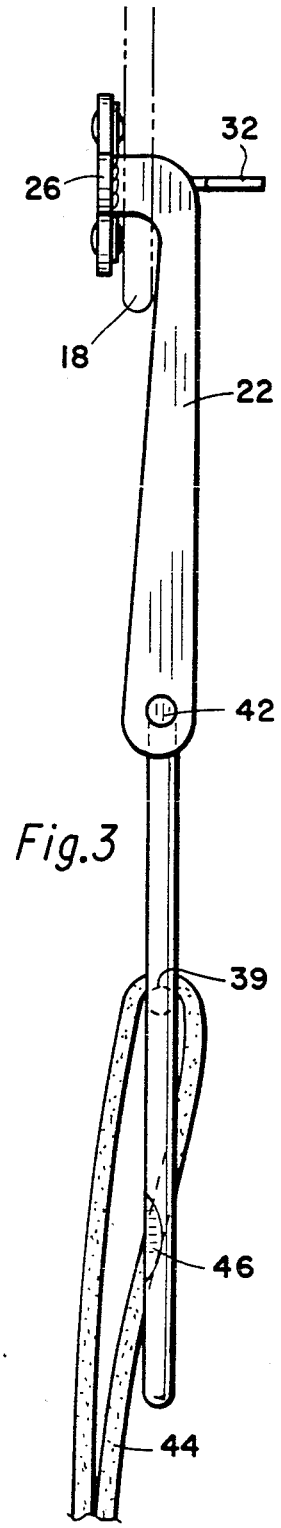
FIG. 3 is a view taken along the line 3—3 of FIG. 2.
Figure 6:
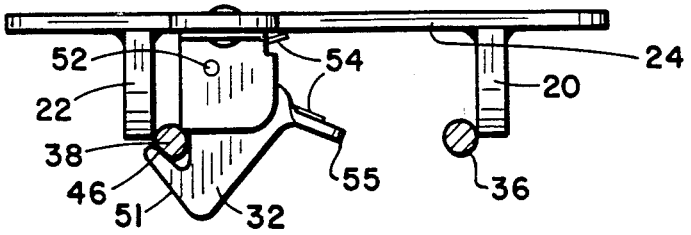
FIG. 6 is a view taken along the line 6—6 of FIG. 4.
Figure 7:
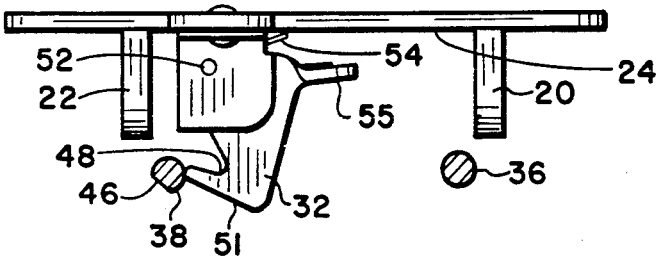
FIG. 7 is similar to FIG. 6 except that the safety latch is in a released position.
Figure 5:
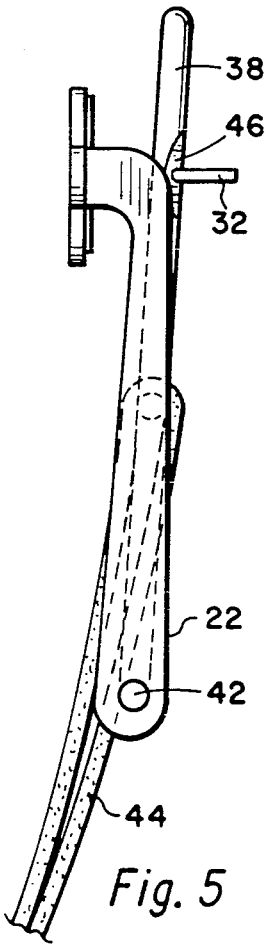
FIG. 5 is a view taken along the line 5—5 of FIG. 4.

We will now discuss that part of the quick cinch which connects into the D-ring 18 on the side flap or skirt of saddle 10. This includes a stop 26 and 28 on either end of cross member 24. As can be seen in FIGS. 2 and 3 these stops 26 and 28 are inserted through and then catch under the D-ring 18. A safety catch 30 having a catch lever 32 is provided on cross member 24. As shown in FIGS. 6 and 7 the safety catch lever 32 is pivoted about pivot 52 and is biased toward the position shown in FIG. 6 by spring 54.

Figure 4:
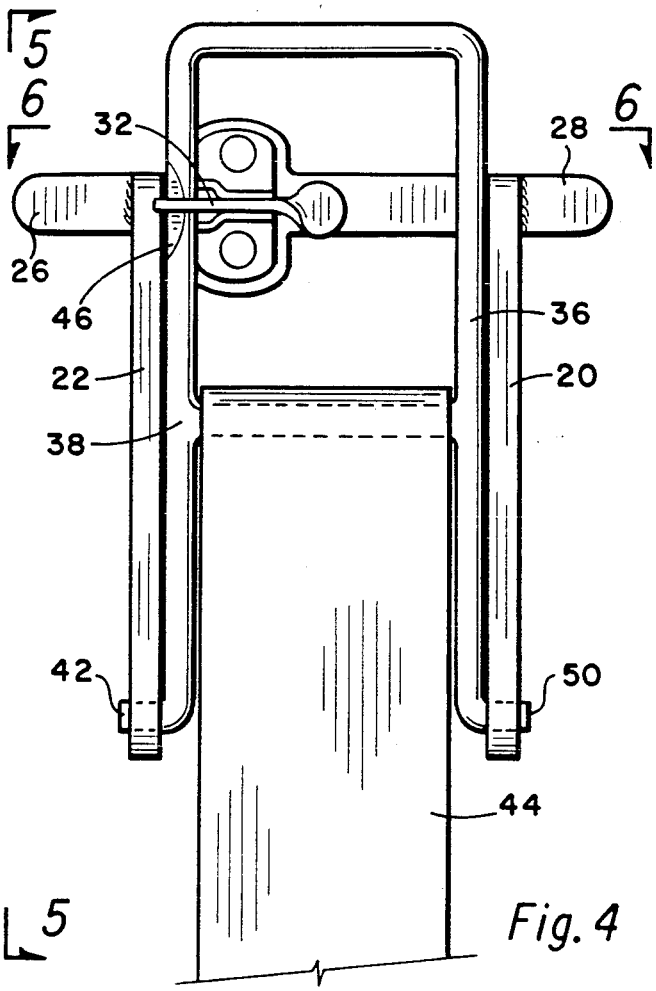
FIG. 4 shows the quick cinch of FIG. 2 in a tightened and locked position.

When a horse is to be saddled, the saddle is first placed on the horse with the girth as shown in FIG. 8 with the quick cinch attached thereto. Ring 64 and tongue 66 is connected in the small usuall manner to the side of of the saddle, which is not shown. The tongue 60 of ring 62 of the girth is placed into the appropriate hole 45 of leather strap 44 which has been looped over strap bar 39. Neck stops 26 and 28 are secured under the D-ring 18 as illustrated at the top of FIG. 2. Now all that is necessary to do to tighten the saddle is to grab the cross member 40 of the tightening levers 36 and 38 and move it upwardly about pivot ears 42 and 50 until it reaches the position shown in FIG. 4. As this occurs the sloping surface 51 of catch lever 32 is driven back to compress spring 54 and so that tightening lever 38 can be shoved to the position shown in FIG. 6. When in this position, the springs 54 shove the catch lever 32 back so that tightening lever rod 38 is in mouth 48 of the safety catch lever 32. When in this position the saddle will stay tightened on the horse. When it is desired to take the saddle off of the horse, the safety catch is released by shoving on arm 55 against spring 54 so that the catch will come into release position as shown in FIG. 7. At this time the tightening levers 36 and 38 can be rotated about pivots 42 and 50 to again be in the relaxed position shown in FIG. 2. At this position the strap 44 is disconnected from the girth ring. The quick cinch can be readily removed from behind the D-ring 18 by pulling it and strap 44 through the back of the D-ring.

Figure 11:
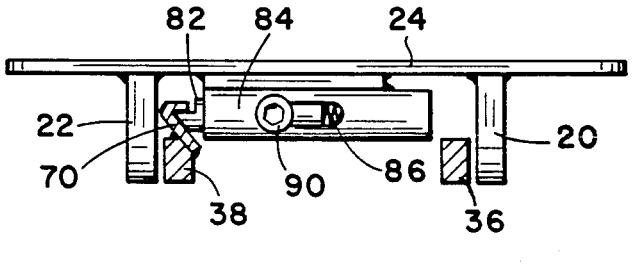
FIG. 11 is similar to FIG. 10 except the latch is in a locked position.
Figure 10:
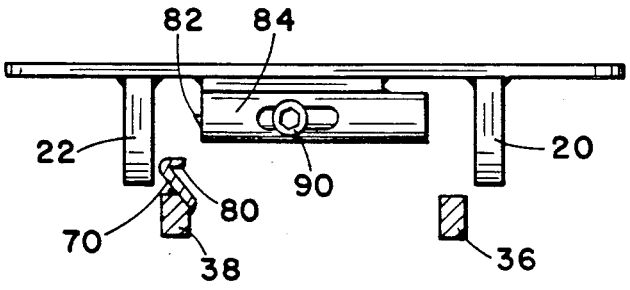
FIG. 10 shows another safety catch in the released position.
Figure 9:
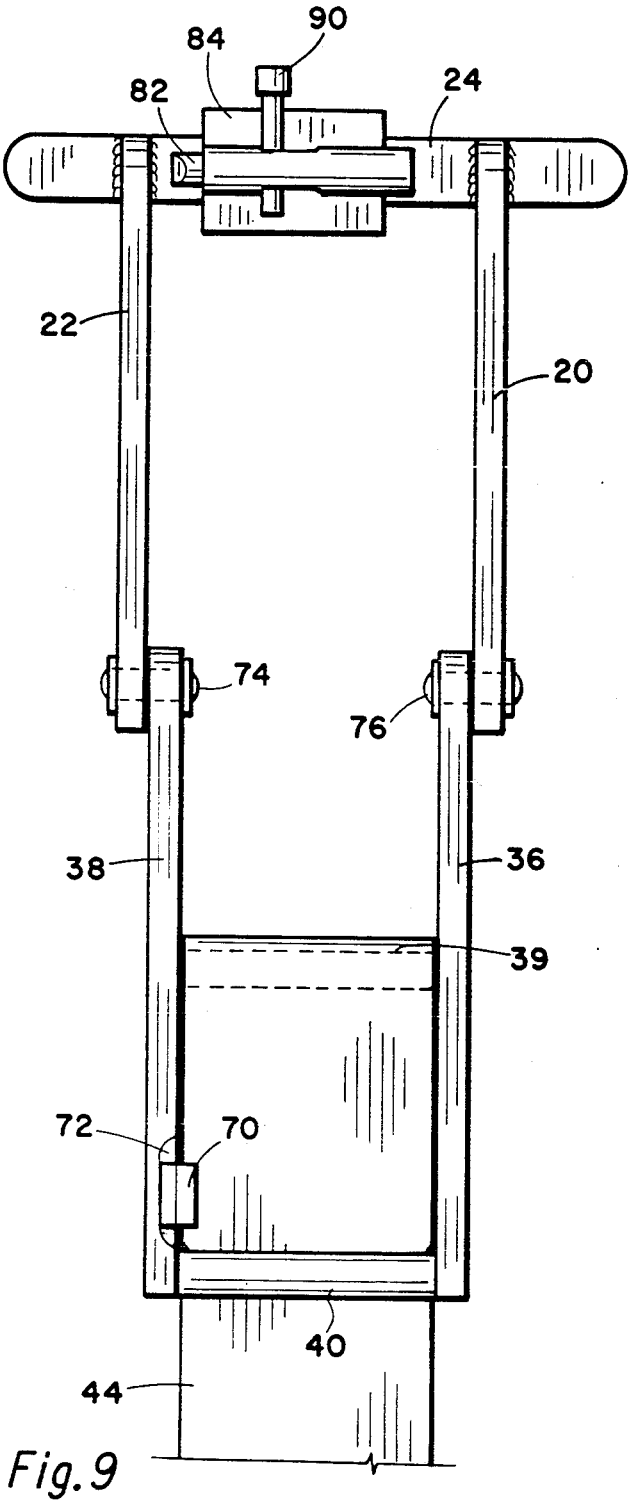
FIG. 9 is similar to FIG. 2 except that the ears have been replaced by pins in connecting the quick cinch together.

Attention is next directed to FIGS. 9, 10 and 11 which shows a slightly different embodiment in that it has different type pivots between the upper or saddle connecting U-shaped member and the lower U-shaped member. A different safety catch is shown although the safety catch shown above may be used. As shown in FIG. 9, a pin 74 is inserted through holes in the ends of tightening lever rod 38 and connecting arm 22 and a second pin 76 is inserted through holes in tightening lever rod 36 and connecting arm 20. These pins may be secured in these holes by any conventional means. These pins 74 and 76 function similar to pivot ears 42 and 50 of FIG. 2. A catch 70 with a fastening lip 80 as shown in FIG. 10 is provided on the lower end of tightening lever rod 38 near cross member 40. A spring loaded safety catch rod 82 is provided in housing 84 which is welded or otherwise secured to cross member 24. A spring 86 urges the safety lever 82 to the position shown in FIGS. 9 and 11. A release rod 90 is provided so that by applying force against the spring 86 the safety rod 82 can be shoved to the position shown in FIG. 10 so that the safety catch is in its released position.

The method of using the embodiments of FIGS. 9, 10 and 11 is quite similar to that of the first embodiment shown in FIG. 2.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What I claim is:

1. A quick cinch for use with a leather strap and a saddle with a saddle ring attached thereto and in which a girth with a ring thereon is used with the saddle for holding the saddle to a horse which comprises:

a first rigid saddle ring connecting U-shaped member having two spaced apart essentially parallel arms and an end member means which extends laterally beyond each of said arms for forming a connector with said saddle ring;

a second rigid U-shaped lever member having two spaced apart essentially parallel arms, a second end member across the two arms and a strap bar between said two arm members intermediate the ends thereof;

pivot means connecting the ends of said arms of one U-shaped member with the arms of the second U-shaped member.

2. A quick cinch as defined in claim 1 including a safety catch for holding said end member means with respect to said second end member until the safety catch is released.

3. A quick cinch as defined as claim 2 in which said pivot means includes a hole in the end of each arm of said first U-shaped member and pivot ears extending outwardly from the end of said arms of said second U-shaped member through said holes.

4. A quick cinch as defined in claim 2 in which said pivot means includes a hole in the end of each said arms and a pin through each corresponding pairs of arms.

5. An apparatus for use with a horse which comprises:

a saddle having a saddle ring, a girth, a girth ring, and a strap;

a saddle connecting U-shaped member having two spaced apart connecting arms and a top bar connecting two ends of said connecting arms, said top bar being provided with connecting means for connecting the top bar to said saddle ring;

a lever U-shaped member having two parallel lever arms and a strap bar connected between said lever arms intermediate the ends thereof and being essentially perpendicular to said lever arms;

pivot means for connecting each of said lever arms to one of said connecting arms.

6. An apparatus as defined in claim 5 including a safety catch attached to said top bar for holding one of said lever amrs.

7. A quick cinch for use with a leather strap and a saddle with a saddle ring attached thereto in which a girth with a ring thereon is used with the saddle for holding the saddle to a horse which comprises:

a first rigid saddle ring connecting U-shaped member having two spaced apart essentially parallel arms, one end of each arm having a lateral extension means essentially perpendicular to its arm and an end member which is rigidly attached to said lateral extensions means and extends beyond each such extension means for forming a connector with said saddle ring;

a second rigid U-shaped lever member having two spaced apart essentially parallel arms, a second end member across the two arms and a strap member between said two arm members intermediate the ends thereof;

pivot means connecting the ends of said arms of one U-shaped member with the arms of the second U-shaped member.

* * * * *